US009420653B2

(12) United States Patent
Van de Maele et al.

(10) Patent No.: US 9,420,653 B2
(45) Date of Patent: Aug. 16, 2016

(54) LED DRIVER CIRCUIT AND METHOD

(75) Inventors: Wim Piet Van de Maele, Bissegem (BE); Zoran Rankovic, Brussels (BE); Luc Vander Voorde, Blaasveld (BE); Jefferson W. Hall, Chandler, AZ (US)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 1005 days.

(21) Appl. No.: 12/950,935

(22) Filed: Nov. 19, 2010

(65) Prior Publication Data

US 2012/0126719 A1 May 24, 2012

(51) Int. Cl.
*H05B 41/36* (2006.01)
*H05B 33/08* (2006.01)

(52) U.S. Cl.
CPC ..... *H05B 33/0827* (2013.01)

(58) Field of Classification Search
CPC .... H05B 33/083; H05B 33/086; H05B 37/00; H05B 33/0815; H05B 33/0818; H05B 37/029; H05B 41/3925; H05B 41/2828; H05B 33/0803
USPC ..... 362/555; 315/291
See application file for complete search history.

(56) References Cited

U.S. PATENT DOCUMENTS 4,298,869 A 11/1981 Okuno
4,845,481 A 7/1989 Havel
5,184,114 A 2/1993 Brown
5,350,977 A 9/1994 Hamamoto
5,420,482 A 5/1995 Phares
6,016,038 A 1/2000 Mueller et al.
6,150,774 A 11/2000 Mueller et al.
6,285,139 B1 9/2001 Ghanem
6,806,659 B1 10/2004 Mueller et al.
6,989,807 B2 1/2006 Chiang
8,035,311 B2 * 10/2011 Prexl et al. ..... 315/291
2002/0048177 A1 * 4/2002 Rahm et al. ..... 362/555
2004/0245946 A1 * 12/2004 Halter ..... H01L 25/0753 315/312
2007/0262724 A1 * 11/2007 Mednik ..... H05B 33/0818 315/125
2007/0285031 A1 * 12/2007 Shteynberg ..... H02M 3/157 315/294
2009/0026973 A1 * 1/2009 Kato et al. ..... 315/201
2009/0033243 A1 * 2/2009 Gater ..... H05B 33/0848 315/291
2009/0085490 A1 * 4/2009 Awalt et al. ..... 315/200 A
2009/0184663 A1 * 7/2009 Reinle ..... 315/294
2009/0273237 A1 * 11/2009 Inoue ..... 307/10.1
2010/0013412 A1 * 1/2010 Archibald ..... H05B 33/0827 315/294
2010/0194274 A1 * 8/2010 Hoogzaad ..... H05B 33/0803 315/51

(Continued)

OTHER PUBLICATIONS

AND8126-D, NCP5008/NCP5009 Compensation Methods, ON Semiconductor, Application Note, Aug. 2003.*

(Continued)

*Primary Examiner* — Alexander H Taningco
*Assistant Examiner* — Seokjin Kim
(74) *Attorney, Agent, or Firm* — Rennie William Dover

(57) ABSTRACT

An LED driver circuit and a method for driving the LED driver circuit. In accordance with an embodiment the LED driver circuit includes a voltage follower circuit and a calibration circuit coupled to the voltage follower circuit. First and second currents may be injected into the node and a current is sunk from the node. In accordance with another embodiment, the LED driver circuit asserts a non-zero voltage across the light emitting diode in a first phase of a drive cycle and asserts a fixed non-zero current in the light emitting diode in a second phase of the drive cycle.

13 Claims, 9 Drawing Sheets

(56) References Cited

U.S. PATENT DOCUMENTS

| | | | | |
|---|---|---|---|---|
| 2011/0068702 | A1* | 3/2011 | van de Ven et al. | 315/186 |
| 2011/0163693 | A1* | 7/2011 | Hying et al. | 315/297 |

OTHER PUBLICATIONS

NCP5008-D, NCP5008, NCP5009 Backlight LED Boost Driver, ON Semiconductor, Apr. 2006, Rev.7.*

NPL__Electronic__Devices__Boylestad, 'Electronic Devices and Circuit Theory, Third Edition, Robert Boylestad, Louis Nashelsky, Prentice-Hall, Inc. Copyright 1982.*

National Semiconductor Datasheet titled "DS2003 High Current/Voltage Darlington Drivers," pp. 1-7 plus a Notes page, Mar. 12, 2010, www.national.com.

ON Semiconductor Datasheet titled "NCP5623 Triple Output I2C Controlled RGB LED Driver," pp. 1-10, Oct. 2008 —Rev. 6, Publication Order No. NCP5623D, http://onsemi.com.

* cited by examiner

LED DRIVER CIRCUIT AND METHOD

BACKGROUND

The present invention relates, in general, to electronics and, more particularly, to methods of forming semiconductor devices and structure.

In the past, the electronics industry used Light Emitting Diodes (LEDs) for a variety of applications. Improvements in the quality and efficiency of LEDs facilitated the use of LEDs in automotive lighting applications such as for brake lights and taillights. Further advances in LEDs facilitated the use for more traditional AC lighting applications such as traffic lights, fluorescent lights, street lights and other lighting applications. Typical control systems for LED applications converted an AC waveform into a DC voltage and used this DC voltage to power the LEDs. Systems to control LEDs are disclosed in U.S. Pat. No. 6,285,139 issued to Mohamed Ghanem on Sep. 4, 2001 and U.S. Pat. No. 6,989,807 issued to Johnson Chiang on Jan. 24, 2006. Most such LED control systems had a high cost. Other systems to control LEDs are disclosed in U.S. Pat. Nos. 6,038,016, 6,150,774, and 6,806,659 issued to Mueller et al. on Jan. 18, 2000, Nov. 21, 2000, and Oct. 19, 2004, respectively.

Accordingly, it would be advantageous to have a method and circuit for driving one or more LEDs. In addition, it is desirable for the method and circuit to be cost and time efficient to implement.

BRIEF DESCRIPTION OF THE DRAWINGS

The present invention will be better understood from a reading of the following detailed description, taken in conjunction with the accompanying drawing figures, in which like reference characters designate like elements and in which.

Figure 1:
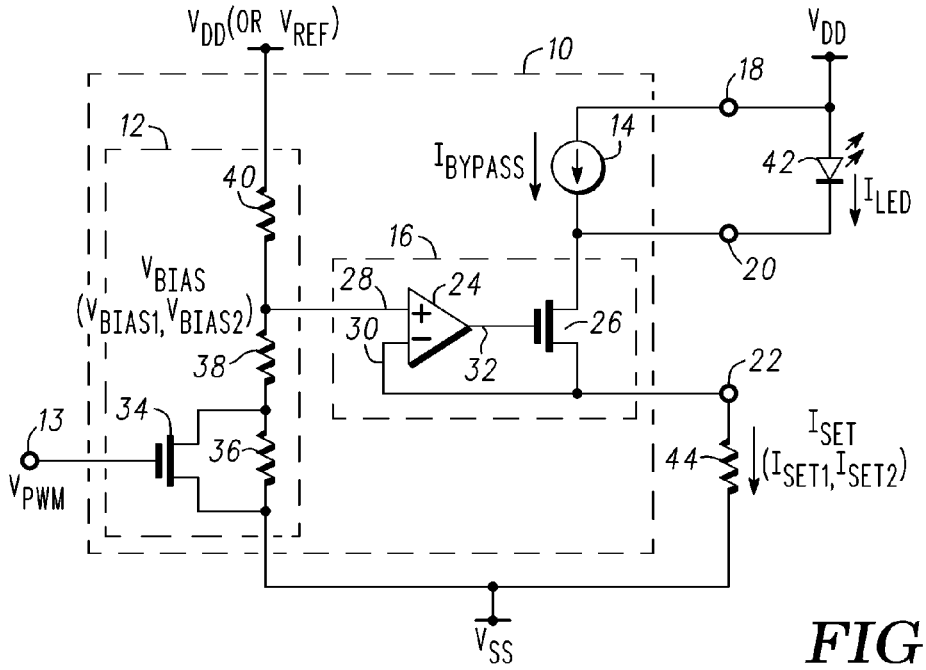
FIG. 1 is a schematic diagram of a portion of an LED driver circuit in accordance with an embodiment of the present invention.

For simplicity and clarity of the illustration, elements in the figures are not necessarily to scale, and the same reference characters in different figures denote the same elements. Additionally, descriptions and details of well-known steps and elements are omitted for simplicity of the description. As used herein current carrying electrode means an element of a device that carries current through the device such as a source or a drain of an MOS transistor or an emitter or a collector of a bipolar transistor or a cathode or anode of a diode, and a control electrode means an element of the device that controls current flow through the device such as a gate of an MOS transistor or a base of a bipolar transistor. Although the devices are explained herein as certain N-channel or P-channel devices, or certain N-type of P-type doped regions, a person of ordinary skill in the art will appreciate that complementary devices are also possible in accordance with embodiments of the present invention. It will be appreciated by those skilled in the art that the words during, while, and when as used herein are not exact terms that mean an action takes place instantly upon an initiating action but that there may be some small but reasonable delay, such as a propagation delay, between the reaction that is initiated by the initial action. The use of the word approximately or substantially means that a value of an element has a parameter that is expected to be very close to a stated value or position. However, as is well known in the art there are always minor variances that prevent the values or positions from being exactly as stated. It is well established in the art that variances of up to about ten percent (10%) (and up to twenty percent (20%) for semiconductor doping concentrations) are regarded as reasonable variances from the ideal goal of exactly as described.

DETAILED DESCRIPTION

Generally the present invention provides a Light Emitting Diode (LED) driver circuit and a method for driving an LED. In accordance with embodiments of the present invention, the LED driver is configured to operate in a high light emission state or a low light emission state. In an aspect, current flows through one or more LEDS in the high and low light emission states. However, the intensity of the light emitted in the high light emission state is much greater than the intensity of the light emitted in the low light emission state. Thus, in the low light emission state the intensity of the light emitted by the one or more diodes may be sufficiently low as to appear off.

In accordance with other embodiments, current may flow through the one or more LEDs in the high light emission state and may not flow through the one or more LEDs during the low light emission state.

FIG. 1 is a circuit schematic of a Light Emitting Diode (LED) driver circuit 10 in accordance with an embodiment of the present invention. LED driver circuit 10 includes a level shift circuit 12 and a current source 14 connected to a voltage follower circuit 16 and a plurality of input/output (I/O) nodes 18, 20, and 22. It should be noted that level shift circuit 12, current source 14, and voltage follower circuit 16 may be monolithically integrated into a single semiconductor substrate or a single semiconductor material. In embodiments in which I/O nodes 18, 20, and 22 are connected to or serve as input/output pins of driver circuit 10, I/O nodes 18, 20, and 22 may be referred to as input/output (I/O) pins. I/O nodes 18, 20, and 22 may also be referred to as I/O terminals. By way of example, voltage follower circuit 16 may be comprised of an operational amplifier 24 coupled to a field effect transistor 26. More particularly, operational amplifier 24 has a noninverting input 28, an inverting input 30, and an output 32 and transistor 26 may be a field effect transistor having a gate, a source, and a drain, where output 32 of operational amplifier 24 is connected to the gate of transistor 26 and inverting input 30 is connected to the source of transistor 26. Input 28 may serve as the input of voltage follower circuit 16 and the commonly connected inverting input 30 and the source of transistor 26 may serve as the output of voltage follower circuit 16. Current source 14 has a terminal that may serve as or alternatively may be connected to I/O node 18 and a terminal connected to the drain of field effect transistor 26 to form a node that may serve as or alternatively may be connected to I/O node 20.

In accordance with an embodiment of the present invention, level shift circuit 12 may include a field effect transistor 34 and a plurality of resistors 36, 38, and 40. Resistor 36 is coupled between the drain and source of field effect transistor 34 where the source and a terminal of resistor 36 are commonly coupled for receiving a source of operating potential $V_{SS}$. By way of example, source of operating potential $V_{SS}$ is ground potential. Resistor 38 is coupled between the drain of field effect transistor 34 and noninverting input 28 of operational amplifier 24 and resistor 40 has a terminal commonly connected to resistor 38 and input 28, and a terminal coupled for receiving a source of operating potential $V_{DD}$. Alternatively, resistor 40 may be coupled for receiving a reference potential $V_{REF}$. The gate of field effect transistor 34 serves as an input 13 of level shift circuit 12 and may be coupled for receiving pulse width modulation signals ($V_{PWM}$).

In operation, a circuit element 42 is coupled between I/O node 18 and I/O node 20 and a set resistor 44 may be connected between I/O node 22 and a source of operating potential such as, for example, $V_{SS}$. By way of example, circuit element 42 is a light emitting diode in which its anode is connected to I/O node 18 and its cathode is connected to I/O node 20. Current source 14 injects a bypass current $I_{BYPASS}$ into I/O node 20 and a set current $I_{SET}$ is sunk from I/O node 22. Set current $I_{SET}$ is generated in accordance with Ohm's Law by developing a voltage across set resistor 44. More particularly, set current $I_{SET}$ is generated in accordance with a pulse width modulation signal $V_{PWM}$ appearing at input 13 such that level shift circuit 12 transmits a bias voltage $V_{BIAS}$ to noninverting input 28 of voltage follower circuit 16. It should be noted that voltage follower circuit 16 and set resistor 44 cooperate to form a current generation circuit. In response to a logic low voltage level appearing at input 13, transistor 34 is off and bias voltage $V_{BIAS}$ is determined as a voltage divider relationship between resistors 36-40 and voltage sources $V_{SS}$ and $V_{DD}$ or voltage sources $V_{SS}$ and $V_{REF}$ and has a voltage level $V_{BIAS1}$. In response to a logic high voltage level appearing at input 13, transistor 34 is on and bias voltage $V_{BIAS}$ is determined from a voltage divider relationship between resistors 38 and 40, the parallel combination of the on-resistance of transistor 34 and resistor 36 and voltage sources $V_{SS}$ and $V_{DD}$ or voltage sources $V_{SS}$ and $V_{REF}$ and has a voltage level $V_{BIAS2}$, where voltage $V_{BIAS1}$ is greater than voltage $V_{BIAS2}$.

Because operational amplifier 24 is configured as a voltage follower, the voltage appearing at noninverting input 28 appears at inverting input 30 and therefore at I/O node 22. In accordance with embodiments in which voltage $V_{SS}$ is at ground potential, voltage $V_{BIAS}$ appears across resistor 44 and a current $I_{SET}$ flows through resistor 44. Thus, in response to voltage $V_{BIAS}$ appearing at noninverting input 28 being at voltage level $V_{BIAS1}$, a set current $I_{SET}$ having a value or current level of $I_{SET1}$ flows through set resistor 44 and in response to voltage $V_{BIAS}$ appearing at noninverting input 28 being at voltage level $V_{BIAS2}$, set current $I_{SET}$ flows through set resistor 44, where current $I_{SET}$ has a value or current level of $I_{SET2}$. It should be noted that currents $I_{SET1}$ and $I_{SET2}$ are greater than bypass current $I_{BYPASS}$. Kirchoff's Current Law provides that the sum of the currents entering a node equals the sum of the currents leaving that node. To comply with Kirchoff's Current Law, the sum the currents at I/O node 20 is substantially equal to zero. Bypass current, $I_{BYPASS}$, and the current flowing through LED 42, i.e., current $I_{LED}$, flows into I/O node 20. The current flowing out of I/O node 20 is substantially equal to the source-to-drain current of field effect transistor 26. Because the source-to-drain current flows into node 22, the current flowing out of I/O node 20 is equal to set current $I_{SET}$. Thus, set current $I_{SET}$ substantially equals the sum of bypass current $I_{BYPASS}$ and LED current $I_{LED}$.

As discussed above, set current $I_{SET}$ may have a value or current level $I_{SET1}$ or a value or current level $I_{SET2}$ where both current levels $I_{SET1}$ and $I_{SET2}$ are greater than the current level of bypass current $I_{BYPASS}$. In accordance with embodiments in which set current $I_{SET}$ is at a current level $I_{SET1}$, the current $I_{SET}$ is much larger than current $I_{BYPASS}$, thus LED current $I_{LED}$ is sufficiently large, as set forth by Kirchoff's Current Law, to cause LED 42 to emit light having a high intensity. In accordance with embodiments in which set current $I_{SET}$ is at a current level $I_{SET2}$, current $I_{SET}$ is minimally larger than current $I_{BYPASS}$, and, in accordance with Kirchoff's Current Law, LED current $I_{LED}$ flows through LED 42 and is injected into I/O node 20. Although current $I_{LED}$ flows and causes LED 42 to emit light, the intensity of the light emitted by LED 42 is much less than that emitted when operating in the high light emission state. Accordingly, LED 42 is in a low light emission state.

Thus, LED driver circuit 10 is configured to receive a drive signal having a phase in which a non-zero voltage is asserted across the light emitting diode and another phase in which a fixed non-zero current is asserted in the light emitting diode. In response to the assertion of the non-zero current in the light emitting diode set current $I_{SET2}$ is sunk from I/O node 20 and bypass current $I_{BYPASS}$ is injected into I/O node 20. As discussed above, current $I_{SET2}$ is minimally greater than bypass current $I_{BYPASS}$ and the difference between currents $I_{SET2}$ and $I_{BYPASS}$ substantially equals the non-zero current, i.e., LED current $I_{LED}$. In response to set current ISET having current level ISET1, a large current flows through LED 42 and a non-zero voltage is asserted across LED 42.

Thus, LED driver circuit 10 operates in a constant current conduction mode in which LED current $I_{LED}$ continuously flows through LED 42.

Figure 1A:
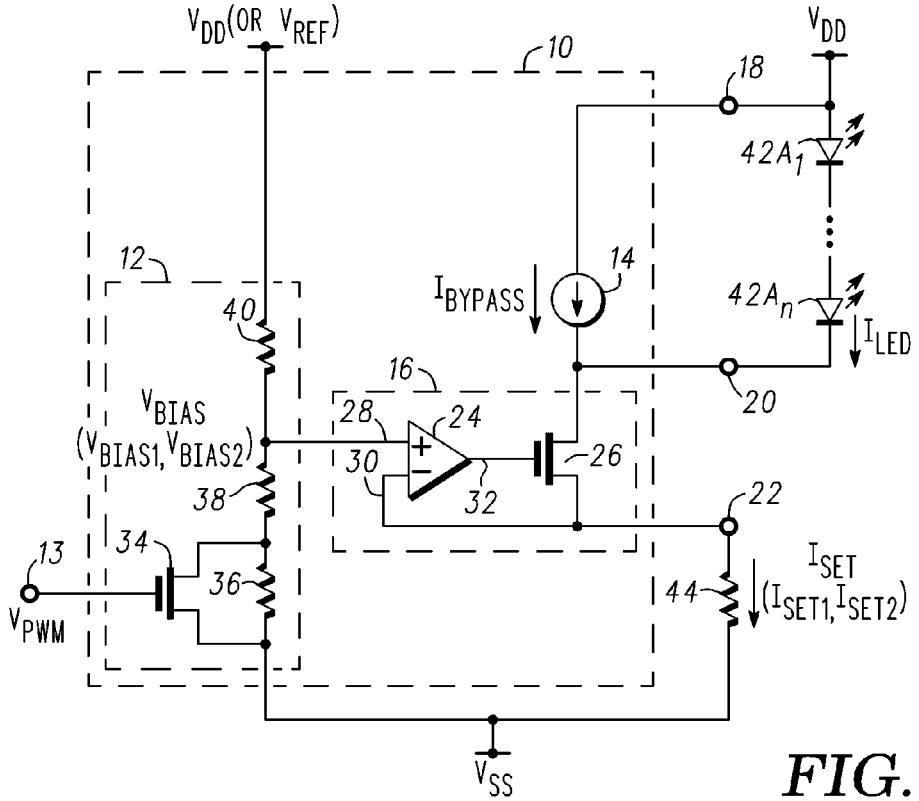
FIG. 1A is a schematic diagram of a portion of an LED driver circuit in accordance with another embodiment of the present invention.

FIG. 1A is a circuit schematic of an LED driver circuit 10 that drives a plurality of LEDs $42A_1$-$42A_n$, where n is an integer.

Figure 2:
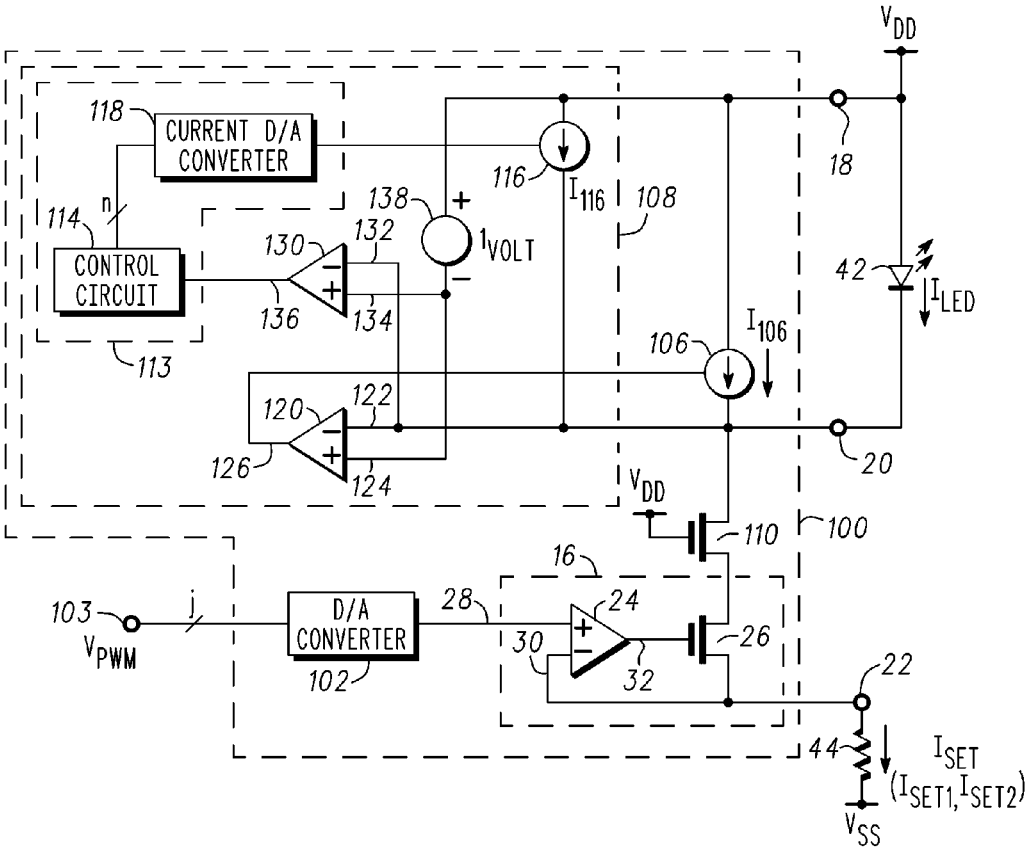
FIG. 2 is a schematic diagram of a portion of an LED driver circuit in accordance with another embodiment of the present invention.

FIG. 2 is a circuit schematic of an LED driver circuit 100 in accordance with another embodiment of the present invention. LED driver circuit 100 includes a j-bit Digital-to-Analog (DAC) circuit 102, a controlled current source 106, and a calibration stage 108 connected to a voltage follower circuit 16 and a plurality of I/O nodes 18, 20, and 22. It should be noted that DAC 102 is a j-bit DAC where j is an integer indicating the number of inputs of DAC 102. By way of example, when j is 4, DAC 102 is a 4-bit DAC having four inputs for receiving a four bit signal. DAC 102, current source 106, voltage follower circuit 16, and calibration stage 108 may be monolithically integrated into a single semiconductor substrate or a single semiconductor material. The current provided to I/O node 20 by current source 116 is identified by reference character $I_{116}$. Calibration stage 108 may be referred to as a compensation stage. In embodiments in which I/O nodes 18, 20, and 22 are connected to or serve as I/O pins of driver circuit 100, I/O nodes 18, 20, and 22 are referred to as I/O pins. I/O nodes 18, 20, and 22 may also be referred to as I/O terminals. By way of example, voltage follower circuit 16 may be comprised of an operational amplifier 24 coupled to a field effect transistor 26. More particularly, operational amplifier 24 has a noninverting input 28, an inverting input 30, and an output 32 and transistor 26 may be a field effect transistor having a gate, a source, and a drain, where output 32 of operational amplifier 24 is connected to the gate of transistor 26 and inverting input 30 is connected to the source of transistor 26. Current source 106 has a terminal that may serve as or alternatively may be connected to I/O node 18 and a terminal connected to the drain of field effect transistor 110 to form a node that may serve as or alternatively may be connected to I/O node 20. The current provided to I/O node 20 by current source 106 is identified by reference character $I_{106}$. Current source 106 is configured such that current $I_{106}$ compensates for the difference between current $I_{116}$ and current $I_{SET}$. Field effect transistor 110 has a gate coupled for receiving a source of operating potential $V_{DD}$, a source connected to the drain of transistor 26, and a drain connected to I/O node 20. It should be noted that field effect transistor 110 is an optional element that may be absent from LED driver circuit 100. Transistor 26 may be configured to have a large drain-to-source voltage in embodiments in which transistor 110 is absent.

An output of j-bit DAC 102 is connected to noninverting input 28 of operational amplifier 24 and an input of j-bit DAC 102 is coupled for receiving PWM signals $V_{PWM}$ at terminal 103.

In accordance with another embodiment of the present invention, calibration circuit 108 may include a controller 113 comprising a digital control circuit 114 having an n-bit output coupled to a control terminal of a controlled current source 116 through an n-bit current DAC 118, where n is an integer. Thus, digital control circuit 114 converts an input signal into an n-bit output signal. It should be noted that DAC 118 is an n-bit DAC where n is an integer indicating the number of inputs of DAC 118. By way of example, when n is 6, DAC 118 is a 6-bit DAC having six inputs for receiving a six bit signal. Controlled current source 116 has a terminal commonly connected to controlled current source 106 and to I/O node 20 and a terminal commonly connected to controlled current source 106 and to I/O node 18. Calibration circuit 108 further includes an operational amplifier 120 and a comparator 130. Operational amplifier 120 has an inverting input 122, a noninverting input 124, and an output 126, where inverting input 122 is commonly connected to controlled current source 106, controlled current source 116, and to the drain of transistor 110 at I/O node 20. Comparator 130 has a noninverting input 134, an inverting input 132, and an output 136. Noninverting input 134 is commonly connected to noninverting input 124 of operational amplifier 120 and to voltage source 138. Inverting input 132 is commonly connected to inverting input 122 of operational amplifier 124, controlled current source 106, controlled current source 116, the drain of transistor 110, and I/O node 20. Output 136 of comparator 130 is connected to an input of digital control circuit 114. Voltage source 138 is connected between non-inverting input 124 of operational amplifier 120 and I/O node 18. It should be noted that voltage source 138 is also connected between inverting input 134 of comparator 130 and I/O node 18.

In operation, a circuit element 42 is connected between I/O node 18 and I/O node 20, a set resistor 44 is connected between I/O node 22 and a source of operating potential such as, for example, $V_{SS}$, and I/O node 18 is coupled for receiving a source of potential $V_{DD}$. By way of example, circuit element 42 is a light emitting diode having an anode connected to I/O node 18 and a cathode connected to I/O node 20. As discussed with reference to LED driver circuit 10, a set current $I_{SET}$ is sunk from I/O node 20, which is generated in accordance with Ohm's Lawby developing a voltage across set resistor 44.

LED driver circuit 100 operates in a calibration phase or in an active phase in accordance with signals $V_{PWM}$ that appear at input 103. The calibration phase may be referred to as a compensation phase, a compensation mode, or a calibration mode. The calibration and active phases may be referred to as operating phases. In the calibration phase, input signals $V_{PWM}$ appearing at input 103 are converted by j-bit DAC 102 into an analog signal having a level indicative of operation in the low light emission state. Similarly, in the active phase input signals $Vp_{PWM}$ appearing at input 103 are converted by j-bit DAC 102 into an analog signal having a level indicative of operation in the high light emission state. For example, with DAC 102 being a 4-bit DAC, the output of 4-bit DAC 102 for the low light emission state may be 20 millivolts and the output of 4-bit DAC 102 for the high light emission state may be 320 millivolts. It should be noted that in response to the signals at input 103 being in the calibration phase, current $I_{SET}$ having a current level $I_{SET2}$ flows through set resistor 44 and in response to the signals at input 103 being in the active phase, current $I_{SET}$ having a current level $I_{SET1}$ flows through set resistor 44.

In response to the PWM signals $V_{PWM}$ indicating operation in the low light emission state, LED driver circuit 100 operates in the calibration phase and in response to the PWM signals indicating operation in the high light emission state LED driver circuit 100 operates in the active phase. LED driver circuit 100 uses calibration circuit 108 to calibrate the voltage appearing at I/O node 20 to compensate for current changes caused by resistor 44, errors introduced by temperature variation, offset errors associated with operational amplifier 120 or comparator 130, variations caused by the age of one or more circuit elements, or the like. During the calibration phase, LED driver circuit 100 calibrates current source 116 such that the combination of current source 116 and current source 106 sources currents that maintain the voltage at I/O node 20 (and thus the voltage at inverting input 122 of operational amplifier 120 and at inverting input 132 of comparator 130) at a level that is substantially equal to one volt less than voltage $V_{DD}$, i.e., $(V_{DD}-1)$ volts.

More particularly, in response to signal $V_{PWM}$ at input 103 corresponding to the calibration phase, current source 116 is adjusted to compensate for the current $I_{sEr2}$ that flows through set resistor 44 such that the voltage at I/O node 22 is $(V_{DD}-1)$ volts. The value of current $I_{SET2}$ is substantially equal to the voltage at input 28 of voltage follower circuit 16 (plus or minus any offset voltage) minus voltage $V_{SS}$ divided by the resistance value of set resistor 44. For example, the voltage at input 28 may be 20 millivolts, the offset voltage may be zero, the resistance value of set resistor 44 may be 10 Ohms, and voltage $V_{SS}$ may be zero. In this example, current $I_{SET}$ has a value of $I_{SET2}$ which is substantially equal to 2 milliamps. Comparator 130 is used to determine if the voltage at I/O node 20 is below or above the voltage equal to the difference between voltage $V_{DD}$ and 1 volt, i.e., $(V_{D1}-1)$ volts. If the voltage at I/O node 20 is greater than $(V_{DD}-1)$ volts, then the sum of current $I_{116}$ and current $I_{106}$ has a value that is greater than current level $I_{SET2}$. Thus, the voltage signal at the output of comparator 130 is at a logic low voltage. Control circuit 113 generates an "n" bit signal that decrements the signal of n-bit current DAC 118 by one LSB current unit, i.e., the level of current $I_{116}$ is decremented by the amount of current associated with the least significant bit. If the voltage at I/O node 20 is less than ($V_{DD}$−1) volts, then the sum of current $I_{116}$ and current $I_{106}$ has a value that is less than current level $I_{SET2}$. Thus, the voltage signal at the output of comparator 130 is at a logic high voltage level. Control circuit 113 generates an "n" bit signal that increments the signal of n-bit current DAC 118 by one LSB current unit, i.e., the level of current $I_{116}$ is incremented by the amount of current associated with the least significant bit. Because current DAC 118 is an n-bit current DAC, there is granularity in its output current signal which inhibits setting current $I_{116}$ to be exactly equal to current $I_{SET}$. By way of example, a current equal to one least significant bit may be 60 microamperes. Thus, decreasing current $I_{116}$ by one least significant bit decreases current $I_{116}$ by 60 microamperes and increasing current $I_{116}$ by one least significant bit increases current $I_{116}$ by 60 microamperes. Preferably, this determination is made in response to each calibration phase. Thus, during each calibration phase the code for n-bit current DAC 118 will increase or decrease successively until the sum of currents $I_{116}$ and $I_{106}$ approximately equals the current $I_{SET2}$ and the voltage imposed on LED 42 is one volt. As discussed above, this calibration compensates for offset of the amplifier, mismatches of circuit elements, and current variations over temperature.

In response to signal $V_{PWM}$ at input 103 corresponding to the active phase, current $I_{SET}$ has a value of $I_{SET1}$ and the current $I_{LED}$ that flows through LED 42 is substantially equal to current $I_{SET1}$ minus current $I_{116}$ minus the current equal to one least significant bit, i.e., $I_{LED}=I_{SET1}-I_{116}-I_{106}$. If current $I_{116}$ is approximately equal to current level $I_{SET2}$, i.e., the current level of current $I_{SET}$ corresponding to the calibration phase, then current $I_{LED}$ is approximately equal to current level $I_{SET1}-I_{116}$ with a maximum error equivalent to twice the amount corresponding to the least significant bit. It should be noted that current source 116 provides a coarse current adjustment and operational amplifier 120 and current source 106 cooperate to provide a fine current adjustment so that the voltage at noninverting inputs 124 and 134 is one volt below the voltage at I/O node 18. This pulls the voltage at inverting inputs 122 and 132, hence the voltage at I/O node 20 and the cathode of LED 42, closer to one volt lower than the voltage at I/O node 18. It should be further understood that up to one least significant bit (ILSB) of current can be derived from operational amplifier 120 and current source 106 and the rest of the current is derived from current source 116, where current source 116 provides a discrete value and operational amplifier 120 and current source 106 cooperate to provide a continuum of current values. Thus, operational amplifier 120 and current source 106 cooperate to compensate for a difference between current level $I_{SET1}$ and current $I_{116}$ within a window of plus or minus one least significant bit. In the active phase, current $I_{106}$ from current source 106 may change by one LSB because the voltage at inverting input 122 is changing. For example, the voltage at input 28 may be 320 millivolts, the offset voltage may be zero, the resistance value of set resistor 44 may be 10 Ohms, and voltage $V_{SS}$ may be zero. The maximum change in current introduced by the combination of operational amplifier 120 and current source 106 is plus or minus the current value of one least significant bit. In this example, current $I_{SET}$ has a value of $I_{SET1}$ which is substantially equal to 32 milliamps and the current value of one least significant bit is 60 μA. Thus, current $I_{LED}$ is substantially equal to 32 mA-2 mA-120 μA which is approximately equal to 30 mA, which causes LED 42 to emit light at a high intensity. It should be appreciated that the current change introduced by operational amplifier 120 and current source 106 may be less than the current associated with plus or minus one least significant bit, i.e., it can 0 μA, 60 μA, or −60 μA.

As discussed with reference to LED driver circuit 10, set current $I_{SET}$ may have a value or current level $I_{SET1}$ or a value or current level $I_{SET2}$ where both levels $I_{SET1}$ and $I_{SET2}$ are greater than the level of the sum of current $I_{106}$ from current source 106 and current $I_{116}$ from current source 116. In accordance with embodiments in which set current $I_{SET}$ is at a current level $I_{SET1}$, the current $I_{SET}$ is much larger than the sum of current $I_{106}$ and current $I_{116}$, thus, from Kirchofrs Current Law, an LED current $I_{LED}$ flows through LED 42 causing it to emit light. LED 42 operating under this condition is said to be operating in a high light emission state. In accordance with embodiments in which set current $I_{SET}$ is at a current level $I_{SET2}$, current $I_{SET}$ is minimally larger than the sum of currents $I_{106}$ and $I_{116}$, and in accordance with Kirchoff's Current Law, LED current $I_{LED}$ flows through LED 42 into I/O node 20 such that LED 42 emits light. Thus, LED 42 emits light during the high light emission state and during the low light emission state. The highest intensity of the light emission by LED 42 occurs during the on portion of the current period of LED 42, i.e., when current $I_{SET}$ is at current level $I_{SET1}$. Because the intensity of the light emitted by LED 42 is much smaller during the off portion of the current period, i.e., when current $I_{SET}$ is at current level $I_{SET2}$, or during the low light emission state, the contribution of light during the off portion to the average value of the light emission during a period of the LED is small and substantially unaffected by the current level during the low light emission state.

Because the voltage drop across LED 42 is clamped to no less than one volt, LED driver circuit 100 operates in a constant current conduction mode in which LED current $I_{LED}$ continuously flows through LED 42.

Figure 2A:
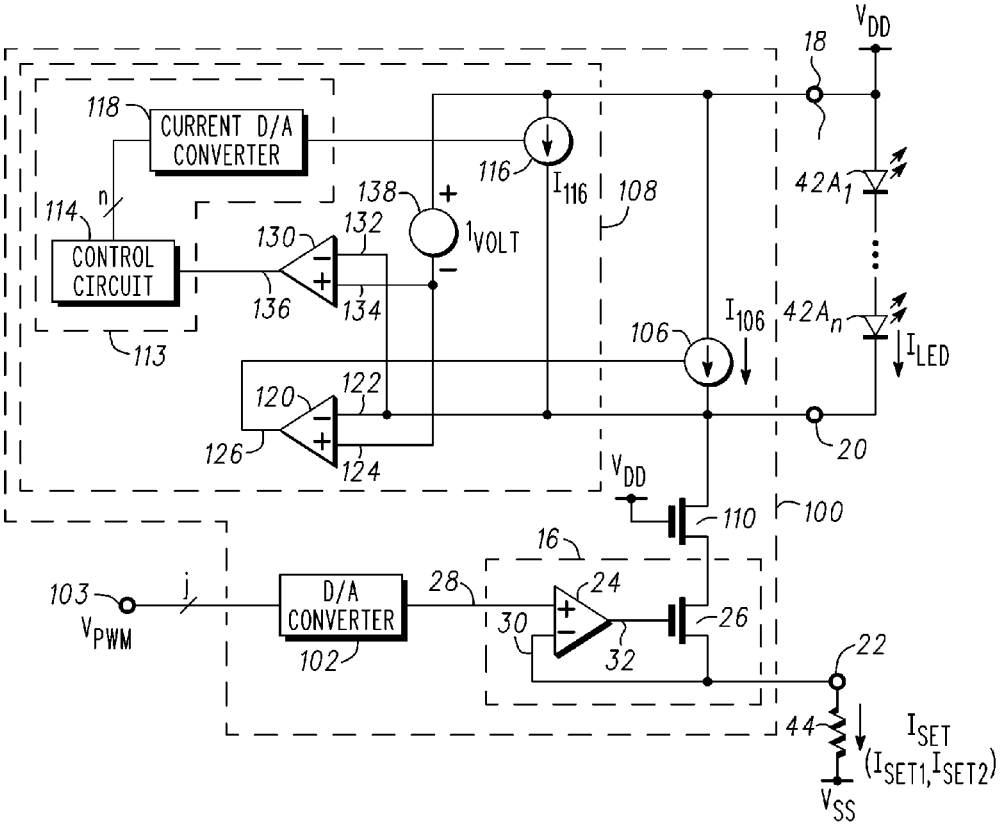
FIG. 2A is a schematic diagram of a portion of an LED driver circuit in accordance with another embodiment of the present invention.

FIG. 2A is a circuit schematic of an LED driver circuit 100 that drives a plurality of LEDs 42$A_1$-42$A_n$, where n is an integer.

Figure 2B:
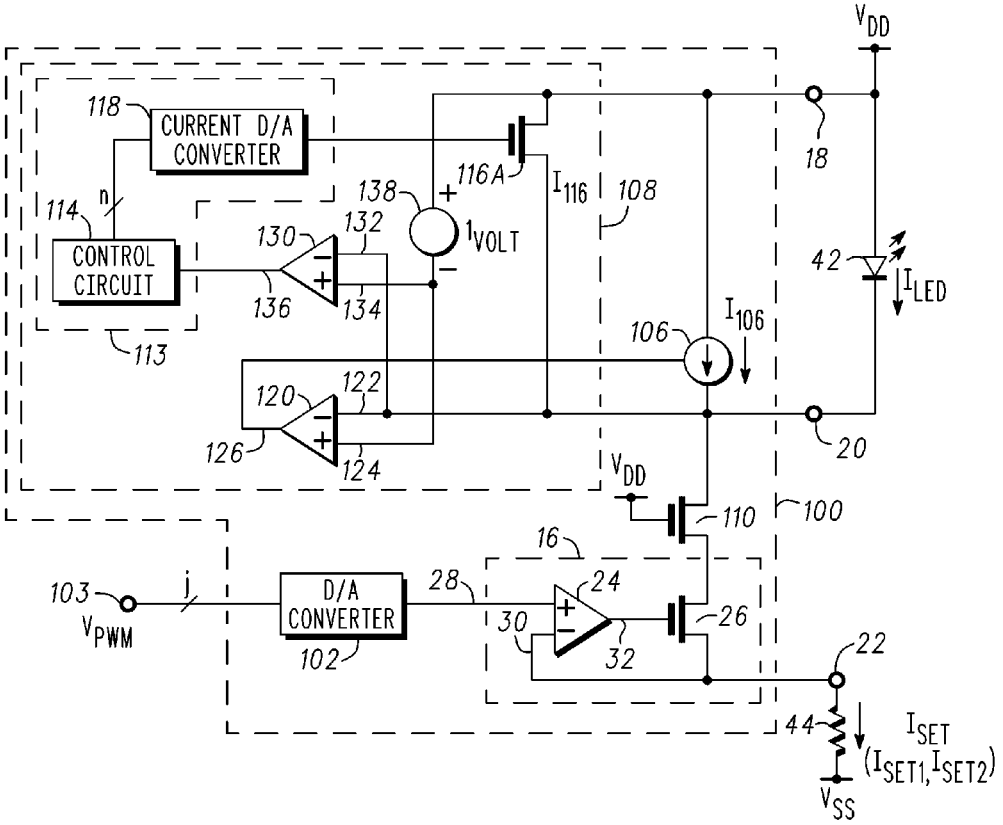
FIG. 2B is a schematic diagram of a portion of an LED driver circuit in accordance with another embodiment of the present invention.

FIG. 2B is a circuit schematic of an LED driver circuit that drives an LED 42A wherein current source 116 shown in FIG. 2 has been replaced by a transistor 116A having a control electrode connected to current D/A converter 118, a current carrying electrode connected to input/output node 18, and a current carrying electrode connected to input/output node 20.

Figure 3:
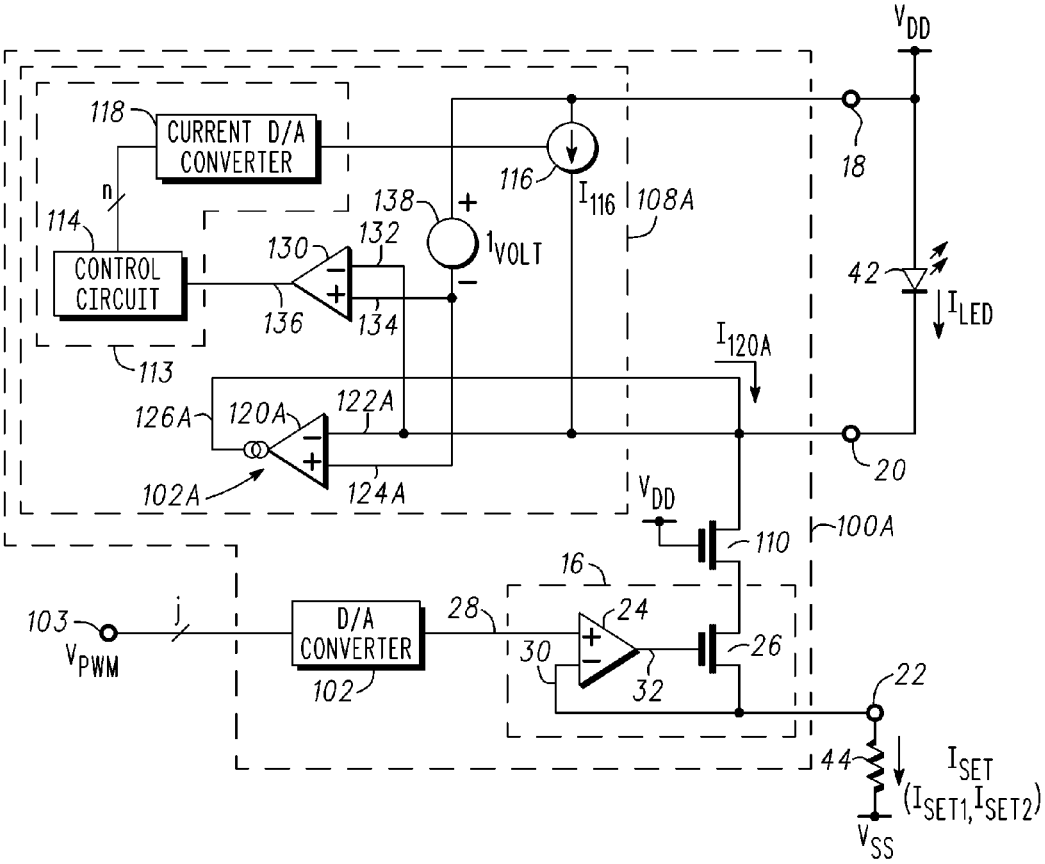
FIG. 3 is a schematic diagram of a portion of an LED driver circuit in accordance with another embodiment of the present invention.

FIG. 3 is a circuit schematic of an LED driver circuit 100A in accordance with another embodiment of the present invention. Like LED driver circuit 100, LED driver circuit 100A includes j-bit DAC 102, voltage follower circuit 16, field effect transistor 110, controller 113, comparator 130, voltage source 138, and current source 116. Operational amplifier 120 and controlled current source 106 are replaced by an operational transconductance amplifier 120A, which has an inverting input 122A, a noninverting input 124A, and an output 126A. Thus, the reference character "A" has been appended to reference character "108" to identify the calibration stage. It should be understood that j-bit DAC 102, voltage follower circuit 16, transistor 110, and calibration stage 108A may be monolithically integrated into a single semiconductor substrate or a single semiconductor material. Noninverting input 134 of comparator 130 and noninverting input 124A of operational transconductance amplifier 120A are commonly connected together and to voltage source 138, inverting input 132 of comparator 130 and inverting input 122A of operational transconductance amplifier 120A are commonly connected together and to output 126A, I/O node 20, the drain terminal of field effect transistor 110, and to a terminal of current source 116.

In response to the signal at input 103 being in the calibration phase, current $I_{SET}$ having a current level $I_{SET2}$ flows through set resistor 44 and in response to the signal at input 103 being in the active phase, current $I_{SET}$ having a current level $I_{SET1}$ flows through set resistor 44. The current provided to I/O node 20 by operational transconductance amplifier 120A is identified by reference character $I_{120}$A.

In operation, a circuit element 42 is connected between I/O node 18 and I/O node 20, a set resistor 44 is connected between I/O node 22 and a source of operating potential such as, for example, $V_{SS}$, and I/O node 18 is coupled for receiving a source of potential $V_{DD}$. By way of example, circuit element 42 is a light emitting diode having an anode connected to I/O node 18 and a cathode connected to I/O node 20. As discussed with reference to LED driver circuit 10, a set current $I_{SET}$ is sunk from I/O node 20, which is generated in accordance with Ohm's Law by developing a voltage across set resistor 44.

Like LED driver circuit 100, LED driver circuit 100A operates in a calibration phase or in an active phase in accordance with signals $V_{PWM}$ that appear at input 103. The calibration phase may be referred to as a compensation phase, a compensation mode, or a calibration mode. In the calibration phase, input signals $V_{PWM}$ appearing at input 103 are converted by j-bit DAC 102 into an analog signal having a level indicative of operation in the low light emission state. Similarly, in the active phase input signals $V_{PWM}$ appearing at input 103 are converted by j-bit DAC 102 into an analog signal having a level indicative of operation in the high tight emission state. For example, with DAC 102 being a 4-bit DAC, the output of 4-bit DAC 102 for the low light emission state may be 20 millivolts and the output of 4-bit DAC 102 for the high light emission state may be 320 millivolts. It should be noted that in response to the signals at input 103 being in the calibration phase, current $I_{SET}$ having a current level $I_{SET2}$ flows through set resistor 44 and in response to the signals at input 103 being in the active phase, current $I_{SET}$ having a current level $I_{SET1}$ flows through set resistor 44.

In response to the PWM signals $V_{PWM}$ indicating operation in the low light emission state, LED driver circuit 100A operates in the calibration phase and in response to the PWM signals indicating operation in the high light emission state LED driver circuit 100A operates in the active phase. LED driver circuit 100A uses calibration circuit 108A to calibrate the voltage appearing at I/O node 20 to compensate for current changes caused by resistor 44, errors introduced by temperature variation, offset errors associated with operational amplifier 120 or comparator 130, variations caused by the age of one or more circuit elements, or the like. During the calibration phase, LED driver circuit 100A calibrates current source 116 such that the combination of current source 116 and operational transconductance amplifier 120A sources currents that maintain the voltage at I/O node 20 (and thus the voltage at inverting input 122 of operational transconductance amplifier 120A and at inventing input 132 of comparator 130) at a level that is substantially equal to one volt less than voltage $V_{DD}$, i.e., $(V_{DD}-1)$ volts.

More particularly, in response to signal $V_{PWM}$ at input 103 corresponding to the calibration phase, current source 116 is adjusted to compensate for the current $I_{SET2}$ that flows through set resistor 44 such that the voltage at I/O node 22 is $(V_{DD}-1)$ volts. The value of current $I_{SET2}$ is substantially equal to the voltage at input 28 of voltage follower circuit 16 (plus or minus any offset voltage) minus voltage $V_{SS}$ divided by the resistance value of set resistor 44. For example, the voltage at input 28 may be 20 millivolts, the offset voltage may be zero, the resistance value of set resistor 44 may be 10 Ohms, and voltage $V_{SS}$ may be zero. In this example, current $I_{SET}$ has a value of $I_{SET2}$ which is substantially equal to 2 milliamps. Comparator 130 is used to determine if the voltage at I/O node 20 is below or above the voltage equal to the difference between voltage $V_{DD}$ and 1 volt, i.e., $(V_{DD}-1)$ volts. If the voltage at I/O node 20 is greater than $(V_{DD}-1)$ volts, then the sum of current $I_{116}$ and current $I_{120}$A has a value that is greater than current level $I_{SET2}$. Thus, the voltage signal at the output of comparator 130 is at a logic low voltage. Control circuit 113 generates an "n" bit signal that decrements the signal of n-bit current DAC 118 by one LSB current unit, i.e., the level of current $I_{116}$ is decremented by the amount of current associated with the least significant bit. If the voltage at I/O node 20 is less than $(V_{DD}-1)$ volts, then the sum of current $I_{116}$ and current $I_{120}$A has a value that is less than current level $I_{SET2}$. Thus, the voltage signal at the output of comparator 130 is at a logic high voltage level. Control circuit 113 generates an "n" bit signal that increments the signal of n-bit current DAC 118 by one LSB current unit, i.e., the level of current $I_{116}$ is incremented by the amount of current associated with the least significant bit. Because current DAC 118 is an n-bit current DAC, there is granularity in its output current signal which inhibits setting current $I_{116}$ to be exactly equal to current $I_{SET}$. By way of example, a current equal to one least significant bit may be 60 microamperes. Thus, decreasing current $I_{116}$ by one least significant bit decreases the current by 60 microamperes and increasing current $I_{116}$ by one least significant bit increases current $I_{116}$ by 60 microamperes. Preferably, this determination is made in response to each calibration phase. Thus, during each calibration phase the code for n-bit current DAC 118 will increase or decrease successively until the sum of currents $I_{116}$ and $I_{120A}$ approximately equals the current $I_{SET2}$ and the voltage imposed on LED 42 is one volt. As discussed above, this calibration compensates for offset of the amplifier, mismatches of circuit elements, and current variations over temperature.

In response to PWM signals $V_{PWM}$ at input 103 corresponding to the active phase, current $I_{SET}$ has a value of $I_{SET1}$ and the current $I_{LED}$ that flows through LED 42 is substantially equal to current $I_{SET1}$ minus current $I_{116}$ minus the current equal to one least significant bit, i.e., $I_{LED}=I_{SET1}-I_{116}-I_{120A}$. If current $I_{116}$ is approximately equal to current level $I_{SET2}$, i.e., the current level of current $I_{SET}$ corresponding to the calibration phase, then current $I_{LED}$ is approximately equal to current level $I_{SET1}-I_{116}$ with a maximum error equivalent to twice the amount corresponding to the least significant bit. It should be noted that current source 116 provides a coarse current adjustment and operational transconductance amplifier 120A provides a fine current adjustment so that the voltage at noninverting inputs 124A and 134 is one volt below the voltage at I/O node 18. This pulls the voltage at inverting inputs 122A and 132, hence the voltage at I/O node 20 and the cathode of LED 42, closer to one volt lower than the voltage at I/O node 18. It should be further understood that up to one least significant bit (1LSB) of current can be derived from operational transconductance amplifier 120A and the rest of the current is derived from current source 116, where current source 116 provides a discrete value and operational transconductance amplifier 120A provides a continuum of current values. Thus, operational transconductance amplifier 120A compensates for a difference between current level $I_{SET1}$ and current $I_{116}$ within a window of plus or minus one least significant bit. In the active phase, current $I_{120A}$ from operational transconductance amplifier 120A may change by one LSB because the voltage at inverting input 122A is changing. For example, the voltage at input 28 may be 320 millivolts, the offset voltage may be zero, the resistance value of set resistor 44 may be 10 Ohms, and voltage $V_{SS}$ may be zero. The maximum change in current introduced by operational transconductance amplifier 120A is plus or minus the current value of one least significant bit. In this example, current $I_{SET}$ has a value of $I_{SET1}$ which is substantially equal to 32 milliamps and the current value of one least significant bit is 60 μA. Thus, current $I_{LED}$ is substantially equal to 32 mA−2 mA−120 μA which is approximately equal to 30 mA, which causes LED 42 to emit light at a high intensity. It should be appreciated that the current change introduced by operational transconductance amplifier 120A may be less than the current associated with plus or minus one least significant bit, i.e., it can 0 μA, 60 μA, or −60 μA.

As discussed with reference to LED driver circuit 10, set current $I_{SET}$ may have a value or current level $I_{SET1}$ or a value or current level $I_{SET2}$ where both levels $I_{SET1}$ and $I_{SET2}$ are greater than the level of the sum of current $I_{120}$A from operational transconductance amplifier 120A and current $I_{116}$ from current source 116. In accordance with embodiments in which set current $I_{SET}$ is at a current level $I_{SET1}$, current $I_{SET}$ is much larger than the sum of current $I_{120}$A and current $I_{116}$, thus, from Kirchoff's Current Law, an LED current $I_{LED}$ flows through LED 42 causing it to emit light. LED 42 operating under this condition is said to be operating in a high light emission state. In accordance with embodiments in which set current $I_{SET}$ is at a current level $I_{SET2}$, current $I_{SET}$ is minimally larger than the sum of currents $I_{120}$A and $I_{116}$, and in accordance with Kirchoff's Current Law, LED current $I_{LED}$ flows through LED 42 into I/O node 20 such that LED 42 emits light. Thus, LED 42 emits light during the high light emission state and during the low light emission state. The highest intensity of the light emission by LED 42 occurs during the on portion of the current period of LED 42, i.e., when current $I_{SET}$ is at current level $I_{SET1}$. Because the intensity of the light emitted by LED 42 is much smaller during the off portion of the current period, i.e., when current $I_{SET}$ is at current level $I_{SET2}$, or during the low light emission state, the contribution of light during the off portion to the average value of the light emission during a period of the LED is small and substantially unaffected by the current level during the low light emission state.

Because the voltage drop across LED 42 is clamped to no less than one volt, LED driver circuit 100A operates in a constant current conduction mode in which LED current $I_{LED}$ continuously flows through LED 42.

Figure 3A:
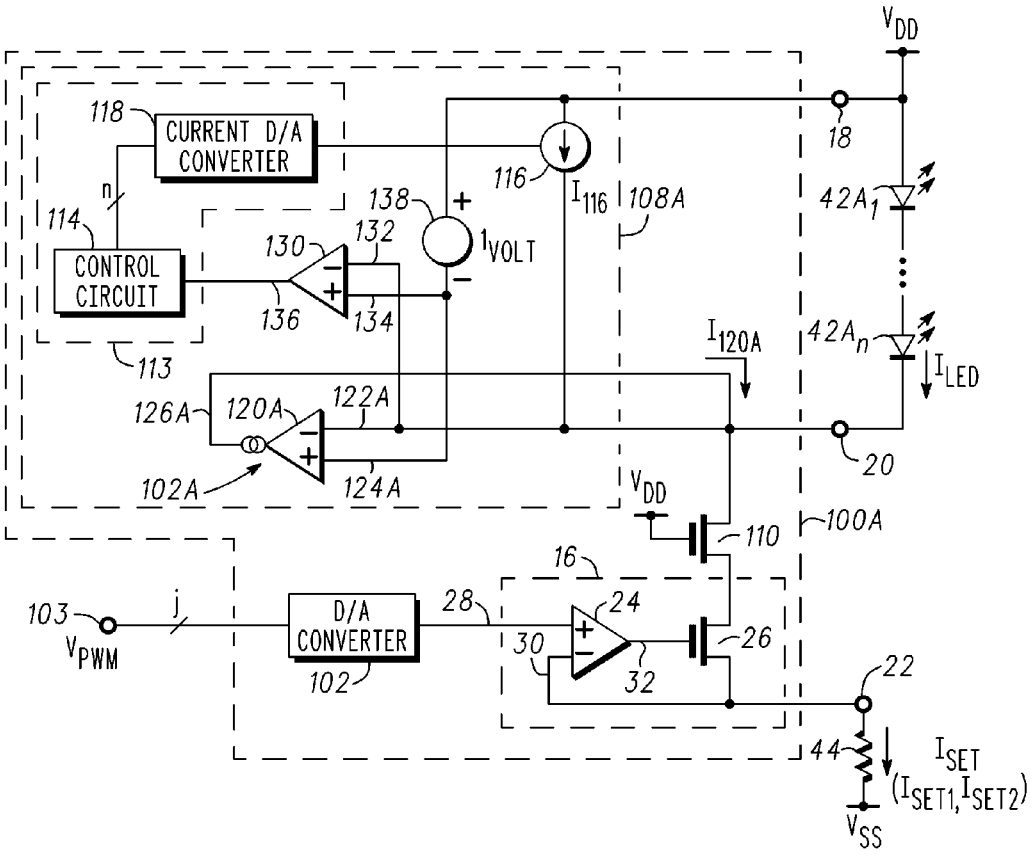
FIG. 3A is a schematic diagram of a portion of an LED driver circuit in accordance with another embodiment of the present invention.

FIG. 3A is a circuit schematic of an LED driver circuit 100 that drives a plurality of LEDs 42$A_1$-42$A_n$, where n is an integer.

Figure 4:
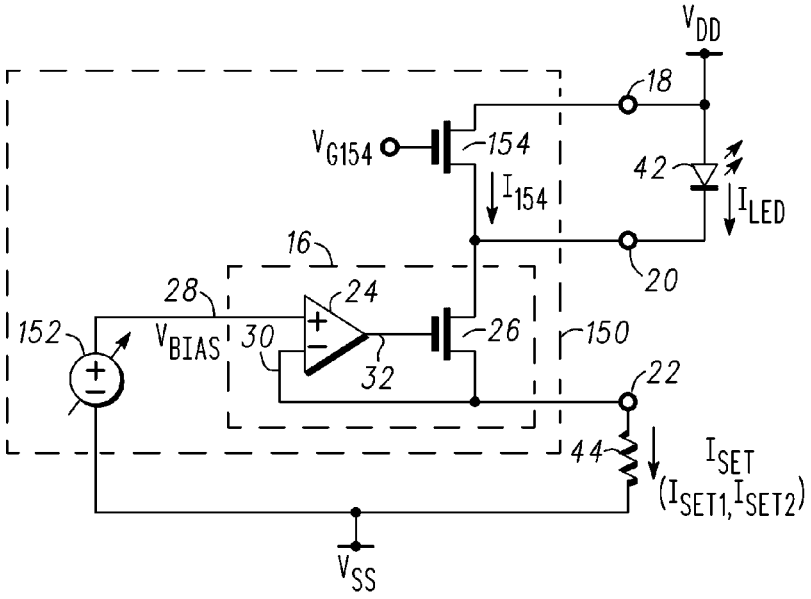
FIG. 4 is a schematic diagram of a portion of an LED driver circuit in accordance with another embodiment of the present invention.

FIG. 4 is a circuit schematic of an LED driver circuit 150 in accordance with another embodiment of the present invention. It should be noted that LED driver circuit 150 may be monolithically integrated into a single semiconductor substrate or a single semiconductor material. LED driver circuit 150 includes a variable voltage source 152 and a field effect transistor 154 connected to a voltage follower circuit 16 and a plurality of I/O nodes 18, 20, and 22. In embodiments in which I/O nodes 18, 20, and 22 are connected to or serve as I/O pins of driver circuit 150, I/O nodes 18, 20, and 22 are referred to as I/O pins. By way of example, voltage follower circuit 16 may be comprised of an operational amplifier 24 coupled to a field effect transistor 26. More particularly, operational amplifier 24 has a noninverting input 28, an inverting input 30, and an output 32 and transistor 26 may be a field effect transistor having a gate, a source, and a drain, where output 32 of operational amplifier 24 is connected to the gate of transistor 26 and inverting input 30 is connected to the source of transistor 26. Transistor 154 has a gate coupled for receiving a gate drive signal $V_{G154}$, a drain that may serve as or alternatively may be connected to I/O node 18 and a source connected to the drain of field effect transistor 26 to form a node that may serve as or alternatively may be connected to I/O node 20.

In operation, a circuit element 42 is coupled between I/O node 18 and I/O node 20 and a set resistor 44 may be connected between I/O node 22 and a source of operating potential such as, for example, $V_{SS}$. By way of example, circuit element 42 is a light emitting diode having its anode connected to I/O node 18 and its cathode connected to I/O node 20. A current equal to the sum of currents $I_{154}$ and $I_{LED}$ flows into I/O node 20 and a current substantially equal to the drain-to-source current of field effect transistor 26 flows from node 20 into node 22. Thus, the current flowing out of or sunk from I/O node 20, i.e., the drain-to-source current of field effect transistor 26, is substantially equal to a set current $I_{SET}$. Set current $I_{SET}$ is generated in accordance with Ohm's Law by developing a voltage'across set resistor 44. More particularly, set current $I_{SET}$ is generated in accordance with a voltage signal $V_{BIAS}$ appearing at noninverting input 28 of operational amplifier 24. Variable voltage source 152 places voltage $V_{BIAS}$ having a voltage level $V_{BIAS1}$ or $V_{BIAS2}$ at inverting input 28 of operational amplifier 24, where voltage $V_{BIAS1}$ is greater than voltage $V_{BIAS2}$.

In a high light emission state, a gate drive voltage $V_{G154}$ that turns off transistor 154 is applied to the gate of transistor 154 and a bias voltage $V_{BIAS1}$ is applied to noninverting input terminal 28. By way of example voltage $V_{BIAS1}$ is 320 millivolts. Because operational amplifier 24 is configured as a voltage follower, the voltage appearing at noninverting input 28 appears at inverting input 30 and therefore at I/O node 22. In accordance with embodiments in which voltage $V_{SS}$ is at ground potential, voltage $V_{BIAS1}$ appears across resistor 44 and a current $I_{SET1}$ flows through resistor 44. For example, in response to bias voltage $V_{BIAS1}$ being 320 millivolts, voltage $V_{SS}$ being ground, and the resistance value of resistor 44 being 10Ω, current $I_{SET1}$, the drain-to-source current of transistor 26 is 32 milliamps. As discussed above, Kirchoff's Current Law provides that the sum of the currents entering a node equals the sum of the currents leaving that node. To comply with Kirchoff's Current Law, the sum of the currents at I/O node 20 is substantially equal to zero. A current equal to the sum of currents $I_{154}$ and $I_{LED}$ flows into I/O node 20 and a current substantially equal to the drain-to-source current of field effect transistor 26 flows from node 20 into node 22. Because the drain-to-source current of transistor 26 is substantially equal to set current $I_{SET}$, and current $I_{154}$ is substantially equal to zero, the LED current $I_{LED}$ equals current $I_{SET}$, which is 32 milliamps for the example above. It should be noted that current $I_{154}$ is the drain-to-source current of transistor 154. Thus, LED 42 emits light in a high light emission state.

In a low light emission state, a gate drive voltage $V_{G154}$ that turns on transistor 154 is applied to the gate of transistor 154 and a bias voltage $V_{BIAS2}$ is applied to noninverting input terminal 28. By way of example voltage $V_{BIAS2}$ is 20 millivolts. Because operational amplifier 24 is configured as a voltage follower, the voltage appearing at noninverting input 28 appears at inverting input 30 and therefore at I/O node 22. In accordance with embodiments in which voltage $V_{SS}$ is at ground potential, voltage $V_{BIAS2}$ appears across resistor 44 and a current $I_{SET2}$ flows through resistor 44. For example, in response to bias voltage $V_{BIAS2}$ being 20 millivolts, voltage $V_{SS}$ being ground, and the resistance value of resistor 44 being 10Ω, current $I_{SET2}$, hence the drain-to-source current of transistor 26, is 2 milliamps. As discussed above, Kirchoff's Current Law provides that the sum of the currents entering a node equals the sum of the currents leaving that node. To comply with Kirchoff's Current Law, the sum of the currents at I/O node 20 is substantially equal to zero. A current equal to the sum of currents $I_{154}$ and $I_{LED}$ flows into I/O node 20 and a current substantially equal to the drain-to-source current of field effect transistor 26 flows from node 20 into node 22. Because the drain-to-source current of transistor 26 is substantially equal to set current $I_{SET}$, and current $I_{154}$ is substantially equal to the drain-to-source current of transistor 26, the LED current $I_{LED}$ is substantially equal to zero for the example above. Thus, LED 42 is in a nonconductive state and does not emit light.

Figure 4A:
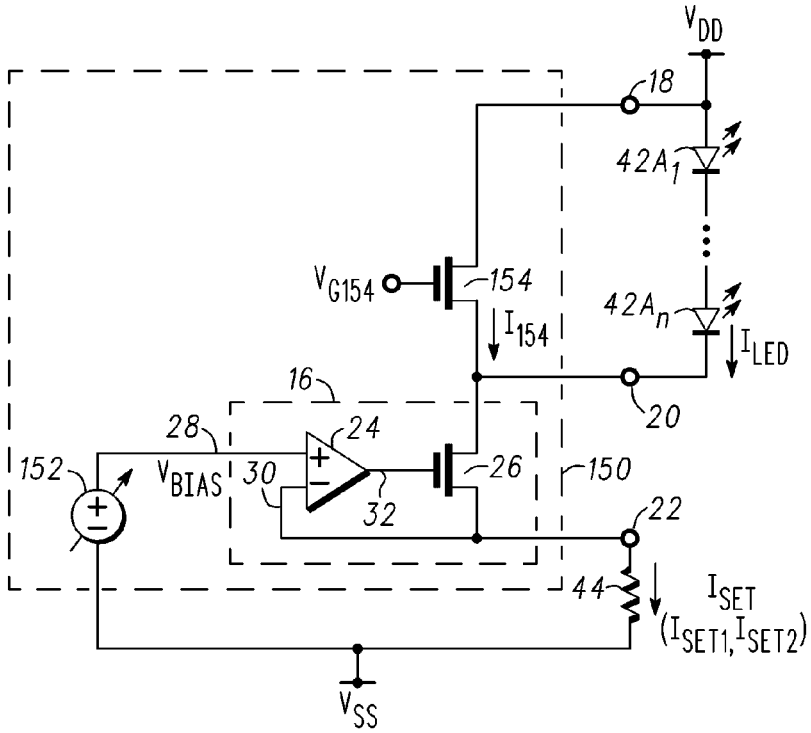
FIG. 4A is a schematic diagram of a portion of an LED driver circuit in accordance with another embodiment of the present invention.

FIG. 4A is a circuit schematic of an LED driver circuit 150 that drives a plurality of LEDs 42$A_1$-42$A_n$, where n is an integer.

Figure 5:
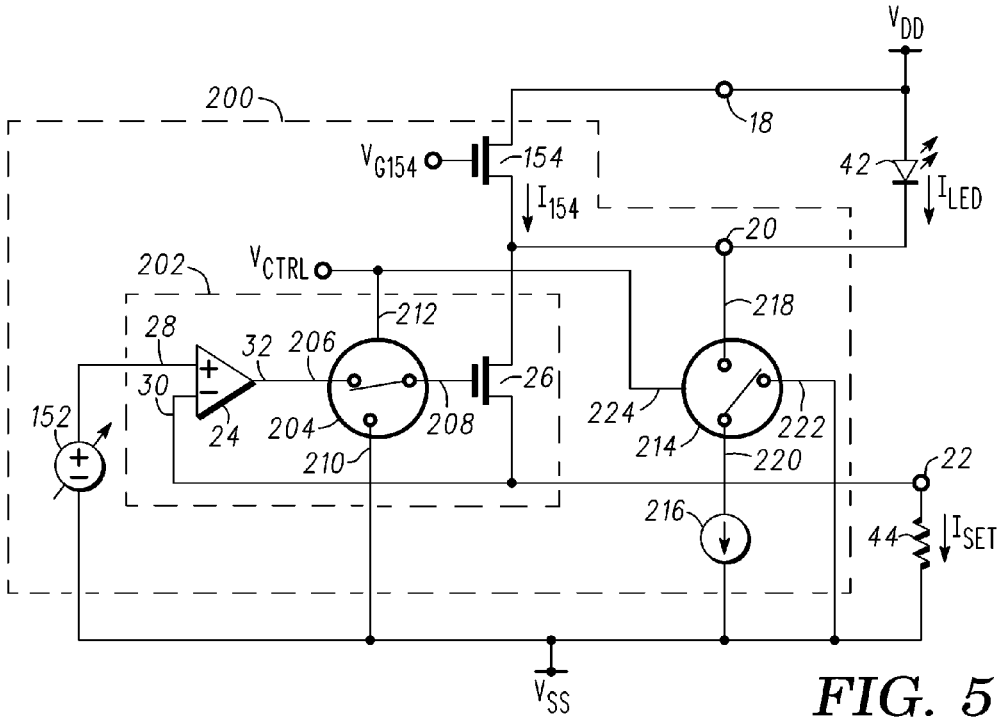
FIG. 5 is a schematic diagram of a portion of an LED driver circuit in accordance with another embodiment of the present invention.

FIG. 5 is a circuit schematic of an LED driver circuit 200 in accordance with another embodiment of the present invention. It should be noted that LED driver circuit 200 may be monolithically integrated into a single semiconductor substrate or a single semiconductor material. LED driver circuit 200 includes a variable voltage source 152 and a field effect transistor 154 connected to a voltage follower circuit 202 and a plurality of I/O nodes 18, 20, and 22. In accordance with embodiments in which I/O nodes 18, 20, and 22 are connected to or serve as I/O pins of driver circuit 200, I/O nodes 18, 20, and 22 are referred to as I/O pins. By way of example, voltage follower circuit 202 may be comprised of an operational amplifier 24 coupled to a field effect transistor 26 through a Single Pole Double Throw (SPDT) switch 204. As described with reference to FIG. 1, operational amplifier 24 has a noninverting input 28, an inverting input 30, and an output 32 and transistor 26 may be a field effect transistor having a gate, a source, and a drain. Switch 204 has conduction terminals 206, 208, and 210 and a control terminal 212. Output 32 of operational amplifier 24 is connected to terminal 206, terminal 208 is connected to the gate of transistor 26, terminal 210 is coupled for receiving a source of operating potential such as, for example, $V_{SS}$, and control terminal 212 is coupled for receiving a switching or control signal $V_{CTRL}$.

Transistor 154 has a gate coupled for receiving a gate signal $V_{G154}$, a drain that may serve as or alternatively may be connected to I/O node 18 and a source connected to the drain of field effect transistor 26 to form a node that may serve as or alternatively may be connected to I/O node 20.

LED driver 200 further includes an SPDT switch 214 and a current source 216 coupled between I/O node 20 and source of operating potential $V_{SS}$. Switch 214 has conduction terminals 218, 220, and 222 and a control terminal 224. Terminal 218 is connected to I/O node 20, terminal 220 is connected to a conduction terminal of current source 216, terminal 222 is coupled for receiving source of operating potential $V_{SS}$, and control terminal 224 is coupled for receiving control signal $V_{CTRL}$.

In operation, a circuit element 42 is coupled between I/O node 18 and I/OS node 20 and a set resistor 44 may be connected between I/O node 22 and a source of operating potential such as, for example, $V_{SS}$. By way of example, circuit element 42 is a light emitting diode having its anode connected to I/O node 18 and its cathode connected to I/O node 20. SPDT switches 204 and 214 are configured so that LED driver circuit 200 operates in the high light emission state or the low light emission state.

In the high light emission state, voltage $V_{G154}$ at the gate of transistor 154 is set so that switching transistor 154 is off and not conducting current and switching signal $V_{CTRL}$ configures switch 204 so that output 32 of operational amplifier 24 is connected to the gate of field effect transistor 26. In addition, switching signal $V_{CTRL}$ configures switch 214 so that both terminals of current source 216 are coupled to the same potential, $V_{SS}$, and substantially no current flows along a current path from I/O node 20 through switch 214 and current source 216. Switch 214 is shown in this position in FIG. 5. Connecting output terminal 32 to the gate of field effect transistor 26 configures operational amplifier 24 as a voltage follower. Because operational amplifier 24 is configured as a voltage follower, the voltage appearing at noninverting input 28 appears at inverting input 30 and therefore at I/O node 22. In accordance with embodiments in which voltage $V_{SS}$ is at ground potential, voltage $V_{152}$ from voltage source 152 appears across resistor 44 and a current $I_{SET}$ flows through resistor 44. Thus, in response to voltage $V_{BIAS}$ appearing at noninverting input 28, a set current $I_{SET}$ flows through set resistor 44. As discussed above, Kirchoff's Current Law provides that the sum of the currents entering a node equals the sum of the currents leaving that node. To comply with Kirchoff's Current Law, the sum of the currents at I/O node 20 is substantially equal to zero. Because switching transistor 154 is off, LED current $I_{LED}$ is equal to set current $I_{SET}$, which is sufficiently high to cause LED 42 to emit light at a high intensity.

In the low light emission state, voltage $V_{G154}$ at the gate of transistor 154 is set so that switching transistor 154 is on and conducting current $I_{154}$ and switching signal $V_{CTRL}$ configures switches 204 and 214 so that the gate of transistor 26 is grounded and I/O node 20 is coupled to source of operating potential $V_{SS}$ through current source 216. Because the gate of field effect transistor 26 is grounded, transistor 26 is nonconductive. As discussed above, Kirchoff's Current Law provides that the sum of the currents entering a node equals the sum of the currents leaving that node. To comply with Kirchoff's Current Law, the sum of the currents at I/O node 20 is substantially equal to zero. Transistor 154 conducts a current $I_{154}$ substantially equal to the current of current source 216. Thus, current $I_{LED}$ of LED 42 is substantially equal to zero and LED 42 does not emit light.

Figure 5A:
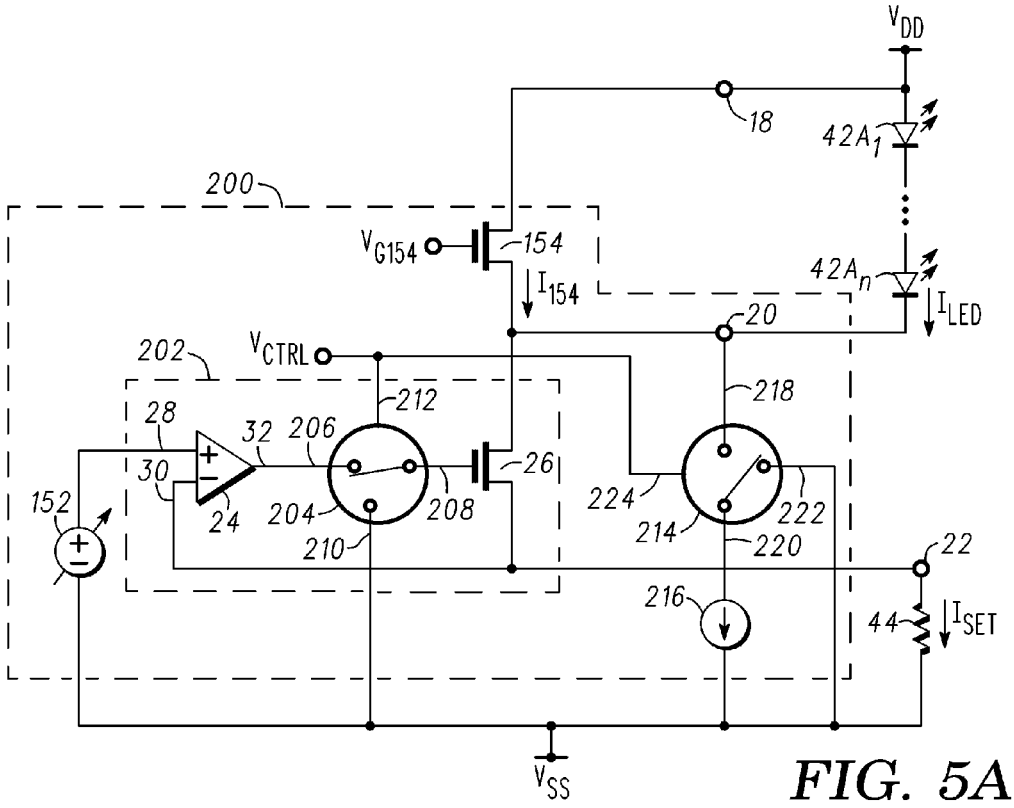
FIG. 5A is a schematic diagram of a portion of an LED driver circuit in accordance with another embodiment of the present invention.

FIG. 5A is a circuit schematic of an LED driver circuit 200 that drives a plurality of LEDs 42$A_1$-42$A_n$, where n is an integer.

Figure 6:
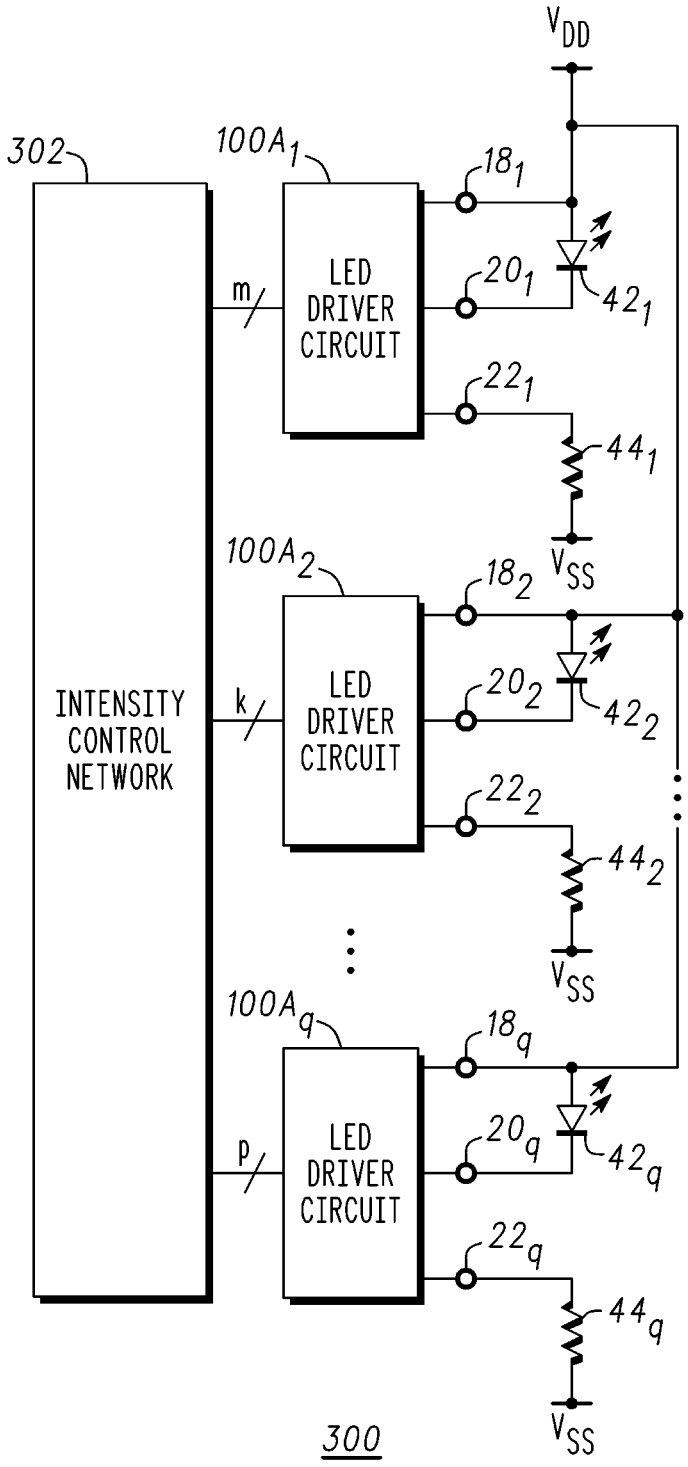
FIG. 6 is a block diagram of an LED lighting system in accordance with another embodiment of the present invention.

FIG. 6 is a circuit schematic of a lighting system 300 in accordance with another embodiment of the present invention. What is shown in FIG. 6 is light intensity control network 302 having a plurality of outputs that send Pulse Width Modulation (PWM) signals to corresponding LED driver circuits. It should be noted that the LED driver circuit may be LED driver circuit 10, LED driver circuit 100, LED driver circuit 100A, LED driver circuit 150, or LED driver circuit 200. By way of example, the LED driver circuit is LED driver circuit 100A and light intensity control network 302 is configured to provide control signals for a plurality of LED driver circuits 100A. To distinguish between the LED driver circuits a subscripted reference character 1, . . . , q has been appended to reference character 100A. Accordingly, LED driver circuits 100A are identified as LED driver circuits 100$A_1$, 100$A_2$, . . . , 100$A_q$, where q is an integer greater than or equal to 1. It should be noted that when q is one, there is a single LED driver circuit 100$A_1$, when q is two there are two LED driver circuits 100A, and 100$A_2$, etc. Similarly, reference characters 1, . . . , q have been appended to the I/O terminals of LED driver circuit 100A to distinguish them from the other LED driver circuits. Thus, LED driver circuit 100A, has I/O nodes $18_1$, $20_1$, and $22_1$, LED driver circuit $100A_2$ has I/O nodes $18_2$, $20_2$, and $22_2$, and LED driver circuit $100A_q$ has I/O nodes $18_q$, $20_q$, and $22_q$.

Each LED driver circuit $100A_1, \ldots, 100A_q$ is connected to intensity control network 302 by one or more signal lines. Reference character m indicates that intensity control network 302 is coupled to LED driver circuit $100A_1$ by m signal lines, where m is an integer greater than or equal. To one, intensity control network 302 is coupled to LED driver circuit $100A_2$ by k signal lines, where k is an integer greater than or equal to one, intensity control network 302 is coupled to LED driver circuit $100A_q$ by p signal lines, where p is an integer greater than or equal to one. It should be noted that m, k, and p may be equal to each other or they may be different from each other.

An LED $42_1$ is coupled between I/O nodes $18_1$ and $20_1$, an LED $42_2$ is coupled between I/O nodes $18_2$ and $20_2$, an LED $42_q$ is coupled between I/O nodes $18_q$ and $20_q$, a resistor $44_1$ is connected between I/O node 22, and source of operating potential $V_{SS}$, a resistor $44_2$ is connected between I/O node $22_2$ and source of operating potential $V_{SS}$, and a resistor $44_q$ is connected between I/O node $22_q$ and source of operating potential $V_{SS}$.

In operation, light intensity control network 302 transmits control signals to LED driver circuits $100A_1$, $100A_2$, . . . , $100A_q$. In response to the control signals from light intensity control circuit 302, LED driver circuits $100A_1$, $100A_2$, . . . , $100A_q$ stimulate corresponding LEDs $42_1$, $42_2$, . . . , $42_9$ to emit light. In accordance with an embodiment in which q equals three (q=3), LED 42 may be a red LED, LED $42_2$ may be a green LED, and LED $42_3$ may be a blue LED. The operation of eachLED driver circuit $100A_1$, $100A_2$, . . . $100A_q$ has been described with reference to FIG. 3. As noted above, lighting system 300 may be comprised of LED driver circuits 10, 150, or 200 rather than LED driver circuit 100A. Thus, lighting system 300 may be comprised of intensity control network 302 coupled to $10_1$, $10_2$, . . . , $10_q$; lighting system 300 may be comprised of intensity control network 302 coupled to $150_1$, $150_2$, . . . , $150_q$; and lighting system 300 may be comprised of intensity control network 302 coupled to LED driver circuits $200_1$, $200_2$, . . . , $200_q$.

Although certain preferred embodiments and methods have been disclosed herein, it will be apparent from the foregoing disclosure to those skilled in the art that variations and modifications of such embodiments and methods may be made without departing from the scope of the invention. It is intended that the invention shall be limited only to the extent required by the appended claims and the rules and principles of applicable law.

What is claimed is:

1. A method for driving a light emitting diode with a driver circuit, comprising:

operating the driver circuit in a calibration phase in response to the light emitting diode emitting light at a first level, wherein operating the driver circuit in the calibration phase includes:

providing a comparator having first and second inputs and an output, the second input coupled to a first node and the output coupled to the first node;

providing a voltage follower circuit having first, second, and third terminals, the first terminal coupled for receiving an input signal from a first digital-to-analog converter circuit, the second terminal coupled to the first node, and the third terminal coupled to a second node;

providing a reference voltage at the first input of the comparator;

generating a first voltage at the second input of the comparator in response to a first current that flows from the first node and a second current that flows towards the first node, the second current having first and second components; and changing a level of the second current in response to the first voltage being more than or less than the reference voltage at the first input of the comparator; and operating the driver circuit in an active phase in response to the light emitting diode emitting light at a second level, the second level greater than the first level, wherein operating the driver circuit in the active phase includes:

generating a third current that flows through the light emitting diode towards the first node.

2. The method of claim 1, further including generating a control signal to change a level of the first component of the second current in response to comparing the voltage at the first node with the reference voltage, wherein the second current is greater than the first current in response to the voltage at the first node being greater than the reference voltage and the second current is less than the first current in response to the voltage at the first node being less than the reference voltage.

3. The method of claim 2, wherein changing the level of the second current in response to the first voltage being more than or less than the reference voltage includes changing the voltage at the first node to be closer to the reference voltage.

4. The method of claim 1, further including:

providing a second digital-to-analog converter, wherein the second digital-to-analog converter is an n-bit digital-to-analog converter; and providing a controlled current source, the controlled current source having a control terminal and first and second current carrying terminals, the control terminal coupled to the n-bit digital-to-analog converter, the first current carrying terminal coupled for receiving a source of operating potential, and the second current carrying terminal coupled to the first node, wherein changing the level of the second current includes increasing the first component of the second current by an amount corresponding to a least significant bit of the n-bit digital-to-analog converter in response to the first voltage being less than the reference voltage or decreasing the first component of the second current by an amount corresponding to a least significant bit of the n-bit digital-to-analog converter in response to the first voltage being greater than the first reference voltage.

5. The method of claim 1, further including generating a fourth current in response to the driver circuit operating in the calibration phase, wherein the fourth current flows through the light emitting diode and has a level equal to a difference between the first current and the second current in response to the second current being less than the first current.

6. A method for driving a light emitting diode, comprising:

providing a voltage follower circuit having first, second, and third terminals;

coupling a first source of current to the second terminal;

coupling a light emitting diode to the second terminal;

providing a driver circuit comprising:

a comparator having first and second inputs and an output, the first input coupled to the first node and a reference voltage coupled to the second input;

a control circuit having an input and an n-bit output, the input coupled to the output of the comparator;

an n-bit digital-to-analog converter having an n-bit input and output, the n-bit input coupled to the n-bit output of the control circuit; and wherein the first source of current has a control terminal, a first current carrying terminal and a second current carrying terminal, the output of the n-bit digital-to-analog converter coupled to the control terminal of the first source of current, the first current carrying terminal coupled for receiving the first source of operating potential, and the second current carrying terminal coupled to the first node;

providing a first voltage at the first input of the comparator;

operating in a calibration phase in response to receiving a first signal at the first terminal, wherein operating in the calibration phase includes:

injecting a first current from the first source of current into a first node;

adjusting the first current from the first source of current in response to the first voltage being greater than or less than the reference voltage;

injecting a second current into the first node, wherein the second current flows through and causes the light emitting diode to emit light at a first emission level, and wherein the second current is at a first level that is a nonzero level and an intensity of the light is at a first emission level; and sinking a third current from the first node, the third current flowing through the third terminal of the voltage follower circuit;

operating in an active phase in response to receiving a second signal at the first terminal, wherein operating in the active phase includes:

increasing the second current to a second nonzero current level that is higher than the first nonzero level, wherein the light emitting diode emits light at a second emission level that is higher than the first emission level.

7. The method of claim 6, wherein providing the driver circuit further includes:

providing an operational amplifier having first and second inputs and an output, wherein the first input of the operational amplifier is coupled to the first node and to the first input of the comparator and the second input of the operational amplifier is coupled to the second input of the comparator;

providing a second source of current, the second source of current having a control electrode and first and second current carrying electrodes, the control electrode of the second source of current coupled to the output of the operational amplifier and the second current carrying electrode coupled to the first node; and adjusting a fourth current from the second source of current in response to the first voltage being greater than or less than the reference voltage.

8. A light emitting diode driver circuit, comprising:

a first amplifier having first and second inputs and an output;

a transistor having a control electrode and first and second current carrying electrodes, the control electrode directly coupled to the output of the first amplifier and the second current carrying electrode coupled to the first input of the first amplifier and to a third node, wherein the transistor provides a first current that flows at a first current level or a second current level through the first current carrying electrode in response to a signal at the second input of the first amplifier;

a first current source having first and second terminals, the first terminal coupled to the first current carrying electrode of the transistor and to a first node and the second terminal coupled to a second node, wherein the light emitting diode drive circuit is configured to always transmit a nonzero current through one or more diodes coupled between the first and second nodes;

a comparator having first and second inputs and an output, the first input coupled to the first node and a voltage source coupled between the second input of the comparator and the second node;

a control circuit having and input and an n-bit output, the input coupled to the output of the comparator;

an n-bit digital-to-analog converter having an n-bit input and an output, the n-bit input coupled to the n-bit output of the control circuit;

a second amplifier having first and second inputs and an output, the first input coupled to the first input of the comparator, the second input coupled to the second input of the comparator and to the voltage source, and the output coupled to the first node.

9. A light emitting diode driver circuit, comprising:

a voltage follower circuit having first and second current carrying terminals;

a first resistor having first and second terminals, the first terminal coupled to the first current carrying terminal of the voltage follower circuit to form a third node, the voltage follower and the first resistor configured to provide a first current capable of flowing at a first current level or a second current level through the voltage follower circuit; and a calibration circuit having first and second terminals, the first terminal serving as a second node and the second terminal coupled to the second current carrying terminal of the voltage follower circuit to form a first node, the calibration circuit comprising a first current source, the first current source having a control terminal and first and second terminals that serve as the first and second terminals of the calibration circuit, the second terminal of the current source coupled to the first node, wherein the calibration circuit further includes comparator having first and second inputs and an output, the first input coupled to the first node and a voltage source coupled between the second input and the second node;

a control circuit having and input and an n-bit output, the input coupled to the output of the comparator;

an n-bit digital-to-analog converter having an n-bit input and output, the n-bit input coupled to the n-bit output of the control circuit, the output of the n-bit digital-to-analog converter coupled to the control terminal of the first current source;

a first amplifier having first and second inputs and an output, the first input coupled to the first input of the comparator, the second input coupled to the second input of the comparator, and the output coupled to the first node.

10. A light emitting diode driver circuit, comprising:

a voltage follower circuit having first and second current carrying terminals;

a first resistor having first and second terminals, the first terminal coupled to the first current carrying terminal of the voltage follower circuit to form a third node, the voltage follower and the first resistor configured to provide a first current capable of flowing at a first current level or a second current level through the voltage follower circuit; and a calibration circuit having first and second terminals, the first terminal serving as a second node and the second terminal coupled to the second current carrying terminal of the voltage follower circuit to form a first node, the calibration circuit comprising a first current source, the first current source having a control terminal and first and second terminals that serve as the first and second terminals of the calibration circuit, the second terminal of the current source coupled to the first node, wherein the calibration circuit further comprises:

a second current source having a control terminal and first and second terminals, wherein the second current source is a controlled current source and wherein the control terminal of the second current source is coupled to the output of the first amplifier, the first terminal is coupled to the second node, and the second terminal is coupled to the first node;

a first operational amplifier having an inverting input, a noninverting input and an output, the output of the first operational amplifier coupled to the control terminal of the second current source;

a voltage source having first and second terminals, the first terminal coupled to the second node and the second terminal coupled to the noninverting input of the first operational amplifier;

a comparator having an inverting input, a noninverting input and an output, the noninverting input of the comparator coupled to the noninverting input of the first operational amplifier and to the second terminal of the voltage source; and a control circuit having an input and output, the input of the control circuit coupled to the output of the comparator and the output of the control circuit coupled to the control terminal of the second current source.

11. The light emitting diode driver circuit of claim 10, further including a current digital-to-analog converter coupled between the control circuit and the control terminal of the second current source.

12. A light emitting diode driver circuit, comprising:

a voltage follower circuit having first and second current carrying terminals;

a first resistor having first and second terminals, the first terminal coupled to the first current carrying terminal of the voltage follower circuit to form a third node, the voltage follower and the first resistor configured to provide a first current capable of flowing at a first current level or a second current level through the voltage follower circuit; and a calibration circuit having first and second terminals, the first terminal serving as a second node and the second terminal coupled to the second current carrying terminal of the voltage follower circuit to form a first node, the calibration circuit comprising a first current source, the first current source having a control terminal and first and second terminals that serve as the first and second terminals of the calibration circuit, the second terminal of the current source coupled to the first node, wherein the calibration circuit comprises:

a voltage source having first and second terminals, the first terminal coupled to the second node;

an operational transconductance amplifier having an inverting input, a noninverting input and an output, the output of the operational transconductance amplifier coupled to the first node;

a comparator having an inverting input, a noninverting input and an output, the noninverting input of the comparator coupled to the noninverting input of the operational transconductance amplifier and to the voltage source and the inverting input of the comparator coupled to the inverting input of the operational transconductance amplifier and to the first node; and a control circuit having an input and output, the input coupled to the output of the comparator and the input coupled to the control terminal of the first current source.

13. The light emitting diode driver circuit of claim 12, further including a current digital-to-analog converter coupled between the control circuit and the control terminal of the first current source and a second current source having a control terminal coupled to the output of the operational transconductance amplifier, a first terminal coupled to the second node, and a second terminal coupled to the first node.

* * * * *